US005187459A

United States Patent [19]

Russell et al.

[11] Patent Number: 5,187,459

[45] Date of Patent: Feb. 16, 1993

[54] COMPACT COUPLED LINE FILTER CIRCUIT

[75] Inventors: Mark E. Russell, Londonderry, N.H.; Anthony M. Donisi, Tewksbury; David C. Miller, Greenfield, both of Mass.

[73] Assignee: Raytheon Company, Lexington, Mass.

[21] Appl. No.: 793,919

[22] Filed: Nov. 18, 1991

[51] Int. Cl.[5] ..... H01P 1/203

[52] U.S. Cl. ..... 333/204; 333/246

[58] Field of Search ..... 333/202, 203, 204, 205, 333/219, 246

[56] References Cited

U.S. PATENT DOCUMENTS 4,371,853 2/1983 Makimoto et al. ..... 333/204

FOREIGN PATENT DOCUMENTS 0038001 3/1982 Japan ..... 333/204
0032401 2/1985 Japan ..... 333/204
0054901 3/1989 Japan ..... 333/204
1262607 10/1986 U.S.S.R. ..... 333/204

OTHER PUBLICATIONS

Jokela, "Narrow-band stripline filter with Transmission zeros at finite frequencies", Circuit Theory & Applications, vol. 7, No. 4, Oct. 1979, pp. 445–461.

Bahl, "Broadbanding Microstrip filters using capacitive Compensation", Applied Microwave, Aug./Sep. 1989, pp. 70–76.

*Primary Examiner*—Paul M. Dzierzynski
*Assistant Examiner*—Seung Ham
*Attorney, Agent, or Firm*—Donald F. Mofford; Richard M. Sharkansky

[57] ABSTRACT

A filter circuit includes a first pair of RF propagation networks disposed to provide a first coupled line section having a first electrical pathlength at a first frequency, means for providing a signal path between an input port of the filter and the first coupled line section and a second pair of RF propagation networks disposed to provide a second coupled line section having a second different electrical pathlength at the first frequency with a first one of the first pair of RF propagation networks coupled to a first one of the second pair of RF propagation network. The filter circuit further includes a third pair of RF propagation networks disposed to provide a third coupled line section having a third different electrical pathlength at the first frequency with a second one of the second pair of RF propagation networks coupled to a first one of the third pair of RF propagation networks and means for providing a signal path between the third coupled line section and an output port of the filter.

10 Claims, 2 Drawing Sheets

COMPACT COUPLED LINE FILTER CIRCUIT

BACKGROUND OF THE INVENTION

This invention relates to radio frequency circuits and more particularly to coupled line filter circuits.

As is known in the art, an RF filter circuit provides a relatively low insertion loss characteristic to all RF signals having a frequency corresponding to one of a first predetermined band of frequencies. This first predetermined band of frequencies is generally referred to as a pass band of the filter circuit. The RF filter further provides a relatively high insertion loss characteristic to RF signals having a frequency corresponding to a second predetermined band of frequencies. This second predetermined band of frequencies is generally referred to a the stop band of the filter circuit. The filter circuit may be provided having a combination of passbands and stopbands to thus provide the filter circuit having the so-called low pass, high pass or bandpass filter characteristics all well known to those of skill in the art.

As is also known in the art, RF filter circuits provided from so-called printed circuit fabrication techniques are preferred because of the low cost and simplicity of the manufacturing process. Printed circuit filters are provided from a plurality of strip conductors disposed on a substrate. Such filter circuits may be provided for example in a so-called microstrip configuration or in a so-called strip line configuration as is well known in the art. In a particular class of printed circuit filters, referred to as coupled line filters, strip conductors are disposed on the substrate in proximity to one another such that coupling occurs between adjacent portions of the strip conductors.

The impedance characteristics of the strip conductors and coupling between the strip conductors cooperate to provide the RF filter circuit having the desired passband and stopband characteristics. Further, the regions of the strip conductors over which coupling occurs are provided having lengths substantially corresponding to one-quarter wavelength at the desired frequency of operation.

Regardless of whether the filter is provided in the microstrip or stripline configurations, the filter circuit includes strip conductors having regions with electrical pathlengths corresponding to one-quarter wavelength at the desired frequency of operation. Moreover, the quarter-wavelength coupling regions are disposed to provide a plurality of coupled line sections with each coupled line section of the filter having substantially identical length.

The filter characteristics (i.e. the insertion loss characteristic, the bandwidth of the filter passband and the slope of the so-called filter skirts) are directly related to the number of quarter-wave coupling sections provided in the filter. For example, many quarter-wave coupling sections are needed to provide a filter having a narrow passband characteristic, sharp filter skirts and a stopband characteristic having a high insertion loss characteristic. Thus, a filter providing the aforementioned electrical characteristics will be a relatively large circuit.

For some applications such as in missile guidance radars, RF filters having the above-mentioned electrical characteristics should be extremely small in size. Conventional printed circuit RF filters require many quarter-wave coupling sections to provide acceptable electrical characteristics and thus are too large for such applications. Furthermore, since the length of the conventional filter is dependent upon the frequency of operation, such filters are necessarily large at low frequencies. This is particularly true of a bandpass filter having a narrow passband characteristic and sharp filter skirts, for example. Thus, it would be desirable to provide a compact filter having predetermined filter characteristics which may be manufactured by conventional, economical fabrication techniques.

SUMMARY OF THE INVENTION

In accordance with the present invention a filter circuit includes a first pair of RF propagation networks disposed to provide a first coupled line section having a first electrical pathlength at a first frequency and means for providing a signal path between an input port of the filter and the first coupled line section. The filter circuit further includes a second pair of RF propagation networks disposed to provide a second coupled line section having a second different electrical pathlength at the first frequency with a first one of the first pair of RF propagation networks coupled to a first one of the second pair of RF propagation networks. The filter circuit further includes a third pair of RF propagation networks disposed to provide a third coupled line section having a third different electrical pathlength at the first frequency with a second one of the second pair of RF propagation networks coupled to a first one of the third pair of RF propagation networks. With this particular arrangement an RF filter circuit having three coupled line sections is provided. By providing the coupled line sections having unequal pathlengths fewer coupling sections are required to provide a filter having a desired filter characteristic compared to that which would be required if all coupled line sections were a quarter wavelength long. If the coupled lines sections are provided as strip conductors disposed on a substrate, the filter circuit may be provided as a printed circuit filter and fabricated via relatively simple and inexpensive manufacturing techniques. Furthermore, a plurality of plated via holes may be provided in the substrate to electrically isolate each coupled line filter section and increase the "Q" of the coupled line sections and prevent degradation of the bandwidth of the passband of the filter circuit. Thus the filter circuit may be provided having steep filter skirts.

BRIEF DESCRIPTION OF THE DRAWINGS

The foregoing features of this invention as well as the invention itself may be fully understood from the following detailed description of the drawings in which.

DESCRIPTION OF THE PREFERRED EMBODIMENTS

Figure 1:
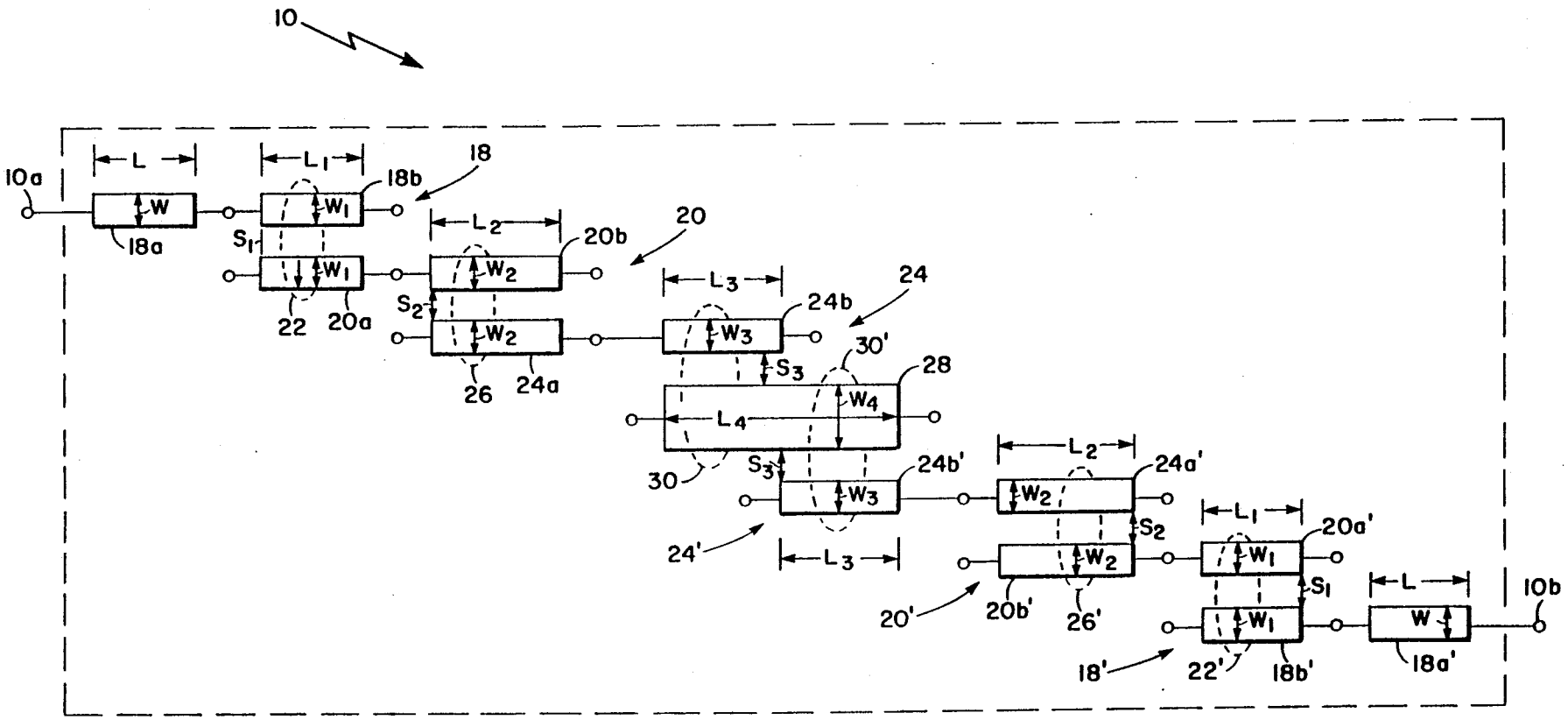
FIG. 1 is a schematic diagram of an RF filter circuit.

Referring now to FIG. 1, a filter circuit 10 having an input port 10*a* and an output port 10*b* includes a first RF propagation network 18*a* having an electrical pathlength L greater than 0.10λ at a first frequency. The RF propagation network 18*a* couples the input port 10*a* of the filter 10 to a second RF propagation network 18*b* having an electrical pathlength L1 in the range of 0.32λ to 0.34λ at the first frequency. A third RF propagation network 20a having the electrical pathlength L1 is spaced a distance S1 from, the second RF propagation network 18b. Thus, the RF propagation networks 18b and 20a provide a first coupled line section 22 having an electrical pathlength L1.

A fourth RF propagation network 20b having an electrical pathlength L2 in the range of 0.15λ to 0.17λ at the first frequency is coupled to the third RF propagation network 20a. A fifth RF propagation network 24a is spaced here a distance S2 from the fourth RF propagation network 20b. Thus, the RF propagation networks 20b and 24a provide a second coupled line section 26 having an electrical pathlength L2.

A sixth RF propagation network 24b having an electrical pathlength L3, in the range 0.26λ to 0.28λ at the first frequency is coupled to the fifth RF propagation network 24a. A seventh RF propagation network 28 having an electrical pathlength L4 in the range of 0.52λ to 0.56λ includes a first region having the electrical pathlength L3 spaced a distance S3 from the RF propagation network 24b. Thus, the RF propagation networks 24b and 28 provide a third coupled line filter section 30.

A corresponding like plurality of RF propagation networks 18a', 18b', 20a', 20b', 24a', 24b' are disposed about RF propagation network 28 to provide coupled line filter sections 22', 26' and 30' respectively. Thus, the filter 10 is provided having six coupled line filter sections 22, 26, 30, and 22', 26' 30' symmetrically disposed about the RF propagation network 28.

Figure 2:
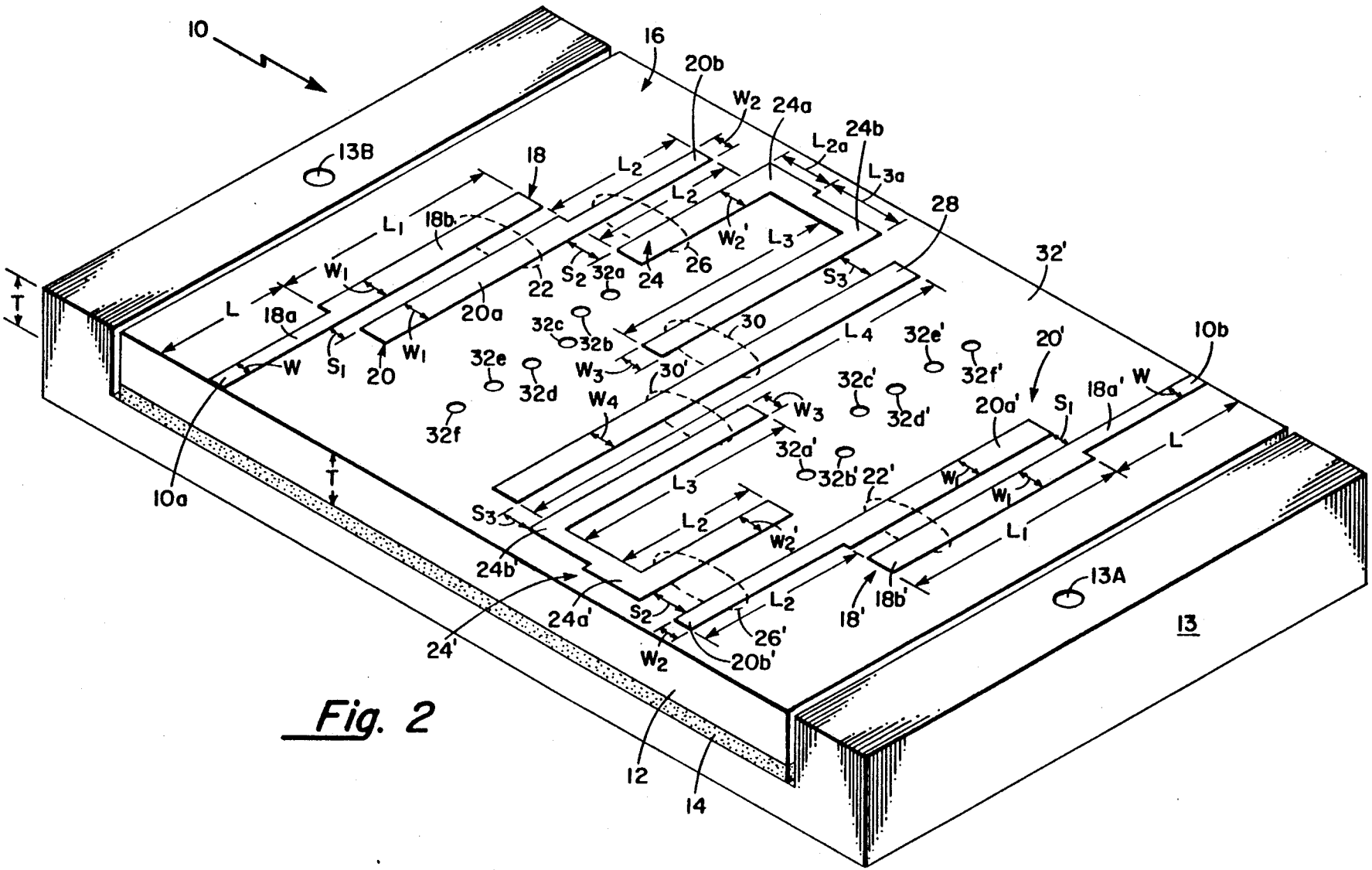
FIG. 2 is an isometric diagram of a preferred embodiment of an RF calibration circuit of the type shown in FIG. 1.

Referring now to FIG. 2, where the elements of the filter circuit 10 of FIG. 1 are referenced with the same designations, the filter circuit 10 includes a substrate 12 having a ground plane conductor 14 disposed on a first surface thereof. The substrate 12 is here provided as alumina having a thickness T typically of about 0.015 inches (in) and a relative dielectric constant typically of about 9.9. Those of skill in the art, however, will recognize that any substrate suitable for use in microwave circuit applications such as GaAs, quartz or Duroid, a registered trademark of the Rogers Corporation may be used.

A plurality of strip conductors generally denoted as 16 are disposed over a second surface of the substrate 12 to provide in combination with the substrate 12 and the ground plane 14 a plurality of microstrip transmission lines 18, 18', 20, 20' 24, 24' and 28 having predetermined line widths $W_1$–$W_4$ and line spacings $S_1$–$S_3$ to provide the filter 10 having a selected band pass filter characteristic. Although the substrate 12 having the above mentioned thickness T and relative dielectric constant are useful to fabricate a filter to be described, for some filter requirements the relative dielectric constant and thickness T of the substrate 12, together with the desired filter characteristics may result in line widths $W_1$–$W_4$ and line spacings $S_1$–$S_3$ which are impractical to fabricate via well known manufacturing techniques. Thus, in those instances, the thickness T and the relative dielectric constant of the substrate 12 may be selected to provide the strip conductors 16 having practical line widths $W_1$–$W_4$ and line spacings $S_1$–$S_3$.

It should be noted here, and those of skill in the art will recognize, that in microstrip circuits an effective dielectric constant may be determined according to the width of a strip conductor and the height and thickness of the substrate. An effective dielectric constant of 6.6 has here been used to calculate the electrical pathlengths provided below.

A first strip conductor 18 disposed over the substrate 12 having a first end coupled to the input port 10a includes a first region 18a having an electrical pathlength L greater than 0.10λ. The region 18a has a line width W typically of about 0.014 inches selected to provide the region 18a having a first impedance characteristic. Here the line width W is selected to provide the region 18a having an impedance characteristic typically of about 50 ohms (Ω).

The strip conductor 18 further includes a second region 18b having an electrical pathlength L1 in the range of 0.32λ to 0.34λ. The region 18b is provided having a line width $W_1$ typically of about 0.019 inches selected to provide the region 18b having a second characteristic impedance.

A second strip conductor 20 disposed over the substrate 12 includes a first region 20a having the electrical pathlength $L_1$ and the line width $W_1$. The region 20a is disposed over the substrate 12 and in proximity to, region 18b. Here region 20a and 18b are spaced by a the distance $S_1$ which is typically about 0.008 inches. Thus, regions 18b and 20a form a first coupled line section 22.

The strip conductor 20 further includes a second region 20b having an electrical pathlength $L_2$ in the range of 0.15λ to 0.17λ. The region 20b is provided having a line width $W_2$ typically of about 0.016 inches.

A third strip conductor 24, here provided having a "U" shape includes a first region 24a having a line width $W_2$, typically of about 0.012 inches. A first portion of the region 24a is provided having the electrical pathlength $L_2$. A second portion of the region 24a is provided having a pathlength $L_{2a}$ typically of about $2W_{2'}+0.025$ inches.

The first portion of the region 24a is disposed in proximity to the region 20b of the second strip conductor 20. Here the regions 24a and 20b are spaced by a distance $S_2$ which is typically of about 0.021 inches. The regions 20b and 24a thus provide a second coupled line section 26.

The third strip conductor 24 further includes a second region 24b having a line width $W_3$ typically of about 0.014 inches. A first portion of the region 24b is provided having an electrical pathlength $L_{3a}$ typically of about $2W_3+0.025$ inches.

A second portion of the second region 24b having an electrical pathlength $L_3$ in the range of 0.26λ to 0.28λ is disposed in proximity to a fourth strip conductor 28. Here the regions 24b and 28 are spaced by a distance $S_4$ which is typically of about 0.019 inches. The strip conductor 28 is provided having a line width $W_4$ typically of about 0.014 inches and an electrical pathlength $L_4$ typically in the range of 0.52λ to 0.56λ. Thus the region 24b and the portion of the strip conductor 28 disposed adjacent to the region 24b provide a third coupled line section 30 having the electrical pathlength $L_3$.

The electrical pathlengths, $L_{2a}$, $L_{3a}$ in combination should provide both physical separation and a predetermined phase length between the coupled line sections 26 and 30 to thus prevent coupling of RF energy between the two sections and also to prevent destructive interference of the propagating RF energy between the two sections. Similarly, the same reasoning applies to corresponding pathlengths of strip conductor 24'.

In the conventional approach, a coupled line filter includes coupled line sections having substantially the same pathlength. Further, in the conventional approach, the length of the coupled line sections substantially corresponds to one quarter wavelength or integer multiples of a quarter wavelength at the frequency of operation.

In the present invention, however, the three coupled line sections 22, 26 and 30 are provided having electrical pathlengths which are substantially different from a quarter wavelength. Moreover, the coupled lines sections 22, 26 and 30 are provided having lengths which are different from each other. Thus, in the present invention, the predetermined filter characteristics may be provided having fewer coupling sections than in the conventional approach. Furthermore, by providing fewer coupling sections and by providing the third strip conductor 24 having a "U" shape, the filter 10 is provided as a compact filter circuit.

The strip conductors 16 ar disposed symmetrically about the strip conductor 28. That is, strip conductors 18' 20' and 24' are disposed symmetrically about the strip conductor 28 to provide coupling sections 22', 26' and 30' substantially corresponding to coupling sections 22, 26 and 30 described above. Thus, a total of six coupled line sections 22, 26, 30, 22', 26' and 30' provide the filter 10 having the desired bandpass filter characteristics.

A plurality of so-called via holes generally denoted **32*a*–32*f* and 32*a'*–32*f'* are disposed through the substrate 12 and provided with a conductive material therein to provide an electrically conductive path between the ground plane conductor 14 and the second surface of the substrate 12. The via holes 32*a*–32*f* provide an electrically conductive wall in the substrate 12 and thus confine the propagating RF energy to the coupled line sections 22 and 26 for example. Moreover the via holes 32*a*–32*f* substantially reduce direct coupling of energy directly between the strip conductors 20 and 28** for example.

Furthermore, the via holes **32*a*–32*f* improve the unloaded "Q" of each of the strip conductors disposed to provide the coupled line sections 22, 26 and 30. The higher Q provides the filter 10 having a lower insertion loss characteristic in the passband and steeper rejection band filter skirts. Likewise, the via holes 32*a'*–32*f'* prevent RF energy from coupling between strip conductors 22' and 28 for example and maintain the "Q" of the coupled line sections 22', 26' and 30, Here twelve plated via holes 32*a*–32*f* and 32*a'*–32*f'* are provided, however an optimum number of via holes may be provided according to the thickness of the substrate, the desired frequency of operation and the desired electrical characteristics of the filter circuit. Here the via holes 32*a*–32*f* and 32*a'*–32*f'*** are provided having a diameter typically of about 0.015 inches (in) and are spaced having a center to center spacing in the range of 0.048 in to 0.072 in.

The substrate 12 is mounted to an electrically conductive base 13. The base 13 may be provided from an electrically conductive material such as Kovar, for example. The base has portions thereof removed to provide a pair of clearance holes 13A and 13B which may be used to mount the filter 10.

Having described the preferred embodiments of the invention, it will now become apparent to one of skill in the art that other embodiments incorporating their concepts may be used. It is felt, therefore, that these embodiments should not be limited to the disclosed embodiments, but rather should be limited only by the spirit and scope of the appended claims.

What is claimed is:

1. A filter circuit comprising:

a pair of first coupled line sections, each first coupled line section having a first electrical pathlength at a first frequency;

a pair of second coupled line sections, each second coupled line section having a second different electrical pathlength at the first frequency with each one of said pair of first coupled line sections coupled to a corresponding one of said pair of second coupled line sections;

a pair of third coupled line sections, each third coupled line section having a third different electrical pathlength at the first frequency with each one of said pair of second coupled line sections coupled to a corresponding one of said pair of third coupled line sections;

wherein one of said pair of third coupled line sections is coupled to the other one of said pair of third coupled line sections and said third electrical pathlength is greater than said second electrical pathlength, but less than said first electrical pathlength.

2. The filter of claim 1 wherein said first electrical pathlength is in the range of 0.32λ to 0.34λ at the first frequency, said second electrical pathlength is in the range of 0.15λ at the first frequency and said third electrical pathlength in the range of 0.26λ to 0.28λ at the first frequency.

3. The filter of claim 2 further comprising means for providing a signal path between an input port of the filter and one of said first coupled line sections comprising a first RF propagation network having a first end coupled to the input port of the filter circuit and a second end coupled to said one of said first coupled line sections and having an electrical pathlength greater than 0.10λ at the first frequency.

4. A filter circuit comprising:

a substrate having first and second opposing surfaces with a ground plane conductor disposed over a first surface thereof;

a common strip conductor disposed over said second surface of said substrate and a pair of filter sections disposed symmetrically about said common strip conductor with each one of the pair of filter sections comprising:

a first pair of strip conductors disposed over a second surface of said substrate to provide a first coupled line section having a first electrical pathlength at a first frequency;

a second pair of strip conductors disposed over the second surface of said substrate to provide a second coupled line section having a second different electrical pathlength at the first frequency with a second one of said first pair of strip conductors coupled to a first one of said second pair of strip conductors; and a third pair of strip conductors with one of said conductors being the common conductor disposed over the second surface of said substrate to provide a third coupled line section having a third different electrical pathlength at the first frequency with a second one of said second pair of strip conductors coupled to a first one of said third pair of strip conductors.

5. The filter of claim 4 wherein the second strip conductor of said second pair of strip conductors and the first strip conductor of said third pair of strip conductors are disposed to provide a "U" shape.

6. The filter of claim 4 wherein said substrate has a plurality of apertures disposed in said substrate between said common strip conductor and said first coupled line section and with said apertures each having an electrically conductive material disposed therein to provide an electrically conductive path between the ground plane conductor and the second surface of the substrate.

7. The filter of claim 4 wherein said first electrical pathlength is in the range of 0.32λ to 0.34λ at the first frequency, said second electrical pathlength is in the range of 0.16λ to 0.17λ at the first frequency and said third electrical pathlength is in the range of 0.26λ to 0.28λ at the first frequency.

8. The filter of claim 5 further comprising a strip conductor having a first end coupled to an input port of the circuit, a second end coupled to a first one of said first pair of strip conductors and having an electrical pathlength greater than 0.10λ at the first frequency.

9. The filter of claim 6 further comprising means for providing a signal path between a second on of said third pair of strip conductors and an output port of the filter.

10. The filter of claim 9 wherein said means for providing a signal path between a second one of said third pair of strip conductors and an output port of the filter comprises a strip conductor having a first end coupled to said second one of said third pair of strip conductors and a second end coupled to the output port of the filter and having an electrical pathlength greater than 0.10λ at the first frequency.

* * * * *